US006100848A

United States Patent [19]

Hayes

[11] Patent Number: 6,100,848

[45] **Date of Patent: *Aug. 8, 2000**

[54] MULTIPLE BAND PRINTED MONOPOLE ANTENNA

[75] Inventor: Gerard James Hayes, Wake Forest, N.C.

[73] Assignee: Ericsson Inc., Research Triangle Park, N.C.

[ * ] Notice: This patent is subject to a terminal disclaimer.

[21] Appl. No.: 09/044,417

[22] Filed: Mar. 20, 1998

Related U.S. Application Data

[63] Continuation of application No. 08/459,553, Jun. 2, 1995.

[51] Int. Cl.[7] ..... H01Q 1/24

[52] U.S. Cl. ..... 343/702; 343/833

[58] Field of Search ..... 343/702, 700 MS File, 343/873, 749, 720, 833

[56] References Cited

U.S. PATENT DOCUMENTS 5,709,832 1/1998 Hayes et al. ..... 264/272.11

5,828,342 10/1998 Hayes et al. ..... 343/702

*Primary Examiner*—Don Wong

*Assistant Examiner*—James Clinger

*Attorney, Agent, or Firm*—Davidson & Gribbell, LLP

[57] ABSTRACT

A printed monopole antenna is disclosed including a printed circuit board having a first side and a second side, a monopole radiating element in the form of a conductive trace formed on one side of the printed circuit board, wherein the conductive trace has an electrical length in which primary resonance occurs within a first specified frequency band, and a parasitic element formed on the opposite side of the printed circuit board, wherein the parasitic element is designed to tune the conductive trace to a secondary resonance within a second specified frequency band. No direct electrical connection between the monopole radiating element and the parasitic element exists, but the coupling between such elements causes the secondary resonance of the radiating element to occur within the second frequency band.

32 Claims, 2 Drawing Sheets

MULTIPLE BAND PRINTED MONOPOLE ANTENNA

CROSS-REFERENCE TO RELATED APPLICATIONS

The current application is a continuation application of U.S. Ser. No. 08/459,553 which was filed on Jun. 2 1995.

BACKGROUND OF THE INVENTION

1. Field of the Invention

The present invention relates to monopole antennas for radiating electromagnetic signals and, more particularly, to a printed monopole antenna including at least one radiating element formed on one side of a printed circuit board having an electrical length where the radiating element has a primary resonance within a first frequency band and a parasitic element formed on the opposite side of the printed circuit board designed to tune a secondary or higher mode resonant response of the radiating element within a second frequency band.

2. Description of Related Art

It has been found that a monopole antenna mounted perpendicularly to a conducting surface provides an antenna having good radiation characteristics, desirable drive point impedance, and relatively simple construction. As a consequence, monopole antennas have been utilized with portable radios, cellular telephones, and other personal communication systems. To date, however, such monopole antennas have generally been limited to wire designs (e.g., the helical configuration in U.S. Pat. No. 5,231,412 to Eberhardt et al.), which operate at a single frequency and associated bandwidth.

In order to minimize size requirements and permit multi-band operation, microstrip and lamina antennas have been developed for use with certain communication applications. More specifically, U.S. Pat. No. 4,356,492 to Kaloi discloses a microstrip antenna system including separate microstrip radiating elements which operate at different and widely separated frequencies while being fed from a single common input point. However, these radiating elements are directly connected with each other and require a ground plane which fully covers the opposite side of a dielectric substrate from such radiating elements. Clearly, this design is impractical for monopole antenna applications, and indeed functions in a completely different manner. Likewise, the lamina antennas disclosed by U.S. Pat. Nos. 5,075,691 and 4,800,392 to Garay et al. require both a direct connection between radiating elements and a ground plane in order to provide multi-band operation.

Further, U.S. Pat. No. 5,363,114 to Shoemaker discloses a planar serpentine antenna which includes a generally flat, non-conductive carrier layer and a generally flat radiator of a preselected length arranged in a generally serpentine pattern secured to the surface of the carrier layer. One form of this antenna has a sinuous pattern with radiator sections in parallel spaced relation in order to provide dual frequency band operation. However, it is seen that the two frequencies at which resonance takes place involves the length of each radiator section and the total length between first and second ends. While this arrangement is suitable for its intended purpose, it likewise is incapable of operating in the fashion of a monopole or dipole antenna.

Accordingly, it would be desirable for a monopole antenna to be developed which not only is operable within more than one frequency band, but also avoids the associated limitations of microstrip and lamina antennas. Further, it would be desirable for a printed monopole antenna to be developed which operates at more than one frequency band and is configured to require only a single radiating element.

In light of the foregoing, a primary object of the present invention is to provide a monopole antenna which is operable within more than one frequency band.

Another object of the present invention is to provide a monopole antenna which can be constructed within very tight tolerances.

Still another object of the present invention is to provide a printed monopole antenna operable within more than one frequency band.

Yet another object of the present invention is to provide a monopole antenna which eliminates ground plane requirements found in microstrip and lamina antennas.

Another object of the present invention is to eliminate direct electric connection between radiating elements of multi-band antennas.

Still another object of the present invention is to provide a printed monopole antenna operable within more than one frequency band that requires only a single radiating element.

A further object of the present invention is to provide a printed monopole antenna which tunes the secondary resonance of a radiating element within a second specified frequency band.

Yet another object of the present invention is to provide a printed monopole antenna which can be easily configured for various frequency bands of operation.

These objects and other features of the present invention will become more readily apparent upon reference to the following description when taken in conjunction with the following drawing.

SUMMARY OF THE INVENTION

In accordance with one aspect of the present invention, a printed monopole antenna is disclosed including a printed circuit board having a first side and a second side. A monopole radiating element in the form of a conductive trace is formed on one side of the printed circuit board, wherein the conductive trace has an electrical length in which primary resonance occurs within a first specified frequency band. A non-resonant parasitic element is formed on the opposite side of the printed circuit board, wherein the parasitic element is designed to tune the conductive trace to a secondary resonance within a second specified frequency band. No direct connection between the monopole radiating element and the parasitic element exists, but the coupling between such elements causes the secondary resonance of the radiating element to occur within the second frequency band. The second frequency band does not include an integer multiple of the primary resonance frequency within the first specified frequency band. In order to produce additional frequency bands of operation, the printed monopole antenna may include more than one radiating element formed on the printed circuit board side opposite of the parasitic element.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 3:
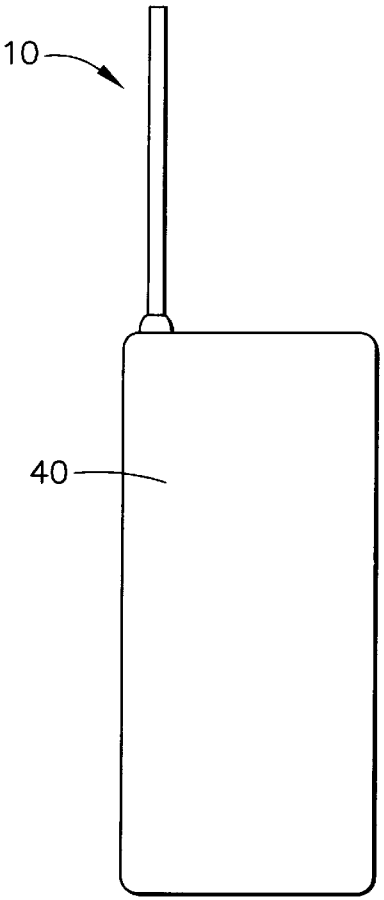
FIG. 3 is a schematic view of the multiple band printed monopole antenna depicted in FIGS. 1 and 2 mounted on a transceiver after the antenna has been overmolded.
Figure 2:
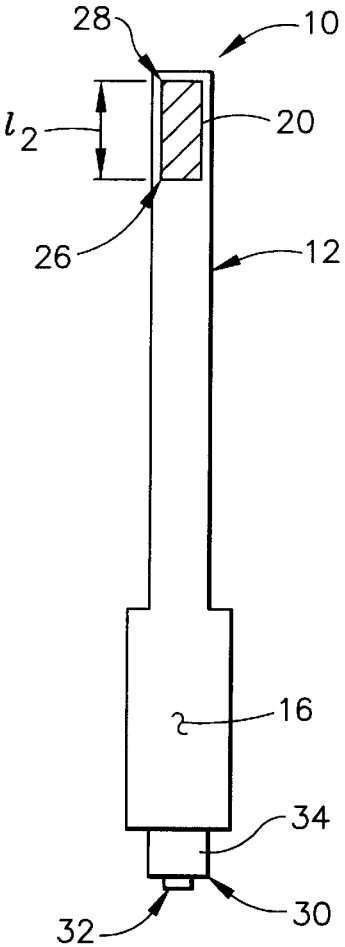
FIG. 2 is a schematic right side view of the multiple band printed monopole antenna depicted in FIG. 1.
Figure 1:
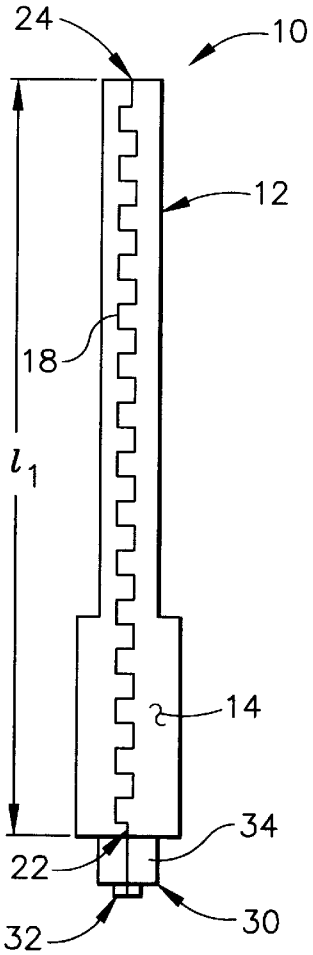
FIG. 1 is a schematic left side view of a multiple band printed monopole antenna in accordance with the present invention.

Referring now to the drawings in detail, wherein identical numerals indicate the same elements throughout the figures, FIGS. 1–3 depict a printed monopole antenna 10 of the type which can be utilized with radio transceivers, cellular phones, and other personal communication equipment having multiple frequency bands of operation. As seen in FIGS. 1 and 2, printed monopole antenna 10 includes a printed circuit board 12, which preferably is planar in configuration and has a first side 14 (see FIG. 1) and a second side 16 (see FIG. 2). It will be noted that printed monopole antenna 10 includes a monopole radiating element in the form of a first conductive trace 18 formed on first side 14 of printed circuit board 12. In addition, a non-resonant parasitic element is formed on second side 16 of printed circuit board 12.

More specifically, it will be seen that first conductive trace 18 has a physical length $l_1$ from a feed end 22 to an opposite open end 24. First conductive trace 18 may have a linear configuration in which its electrical length is substantially equivalent to physical length $l_1$ or it may optionally have a non-linear configuration (as shown in FIG. 1) in which the electrical length therefor is greater than physical length $l_1$. This non-linear type of conductive trace is explained in greater detail in a patent application entitled "Antenna Having Electrical Length Greater Than Its Physical Length," filed concurrently herewith, which is also owned by the assignee of the present invention and hereby incorporated by reference. In any event, it will be understood that the electrical length of first conductive trace 18 will have a primary resonance within a first specified frequency band. Optimally, first conductive trace 18 will have an electrical length which is substantially equivalent to a quarter-wavelength or a half-wavelength for a frequency within the first specified frequency band.

Parasitic element 20, as seen in FIG. 2, covers a specified area of printed circuit board second side 16 in order to tune first conductive trace 18 to have a secondary resonance within a second specified frequency band. Accordingly, it will be understood that the placement of parasitic element 20 along printed circuit board second side 16, as well as the overall size thereof, may be varied in order to achieve the desired frequency band for the secondary resonance of first conductive trace 18. However, it has been found that parasitic element 20 has the greatest effect by being positioned at or adjacent to the open end of printed circuit board 12.

Further, although parasitic element 20 is preferably made of a conductive material, it is not resonant itself since it is substantially smaller in size than the wavelength corresponding to the operating frequency of printed monopole antenna 10 (preferably less than 10% of such wavelength). Accordingly, the physical length $l_2$ of parasitic element 20 is approximately 10% or less than physical length $l_1$ of first conductive trace 18. It follows then, that physical length $l_2$ of parasitic element 20 is approximately 10% less than the electrical length of first conductive trace 18.

Figure 4:
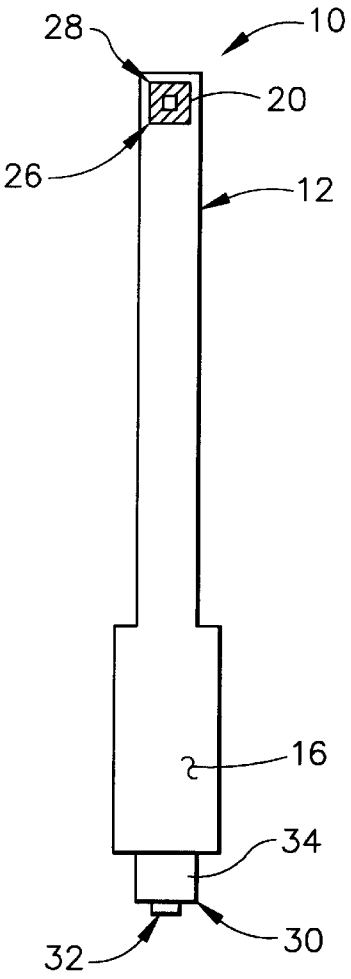
FIG. 4 is a schematic right side view of the multiple band printed monopole antenna depicted in FIG. 1 with an alternative embodiment for the parasitic element formed thereon.

As seen in FIG. 2, parasitic element 20 fully covers printed circuit board second side 16 from a first point 26 to a second point 28. However, because parasitic element need only be positioned around the edges of first conductive trace 18 on printed circuit board second side 16, FIG. 4 depicts a design in which parasitic element 20 only partially covers printed circuit board second side 16 from first point 26 to second point 28. By positioning parasitic element 20 on printed circuit board second side 16, it affects the frequency band at which first conductive trace 18 has a secondary resonance. In this way, such secondary resonance may be tuned to occur within a second frequency band that does not include an integer multiple of the primary resonance frequency. This occurs even though there is no direct electrical connection between first conductive trace 18 and parasitic element 20.

By utilizing parasitic element 20 with first conductive trace 18, printed monopole antenna 10 is able to operate within the aforementioned first and second frequency bands. Preferably, the first frequency band will be approximately 800 MegaHertz to approximately 1,000 MegaHertz while the second frequency band will be approximately 1,800 MegaHertz to approximately 2,000 MegaHertz. Other frequency bands may be utilized for the second frequency band so that printed monopole antenna 10 can communicate with satellites, such as between approximately 1500 MegaHertz and approximately 1600 MegaHertz or between approximately 2400 MegaHertz and 2500 MegaHertz. In order to better accomplish this multi-band frequency operation, it will be understood that first conductive trace 18 will preferably have an electrical length substantially equivalent to either a quarter-wavelength or a half-wavelength of a center frequency within the first frequency band.

Printed monopole antenna 10 also preferably includes a feed port 30, such as in the form of a coaxial connector, which includes a signal feed portion 32 and a ground portion 34. As best seen in FIG. 1, signal feed portion 32 of feed port 30 is coupled only to first conductive trace 18 such as the center conductor of a coaxial connector.

With respect to the construction of printed monopole antenna 10, it is preferred that printed circuit board 12 be made of a flexible dielectric material such as polyamide, polyester, or the like. It is also preferred that first conductive trace 18, parasitic element 20, and printed circuit board 12 be overmolded with a low-loss dielectric material, as further described in a patent application entitled "Method Of Manufacturing A Printed Antenna," filed concurrently herewith, which is also owned by the assignee of the present invention and hereby incorporated by reference. In this regard, printed monopole antenna 10 is schematically depicted in FIG. 3 as being attached in its final form to a radio transceiver 40.

Figure 5:
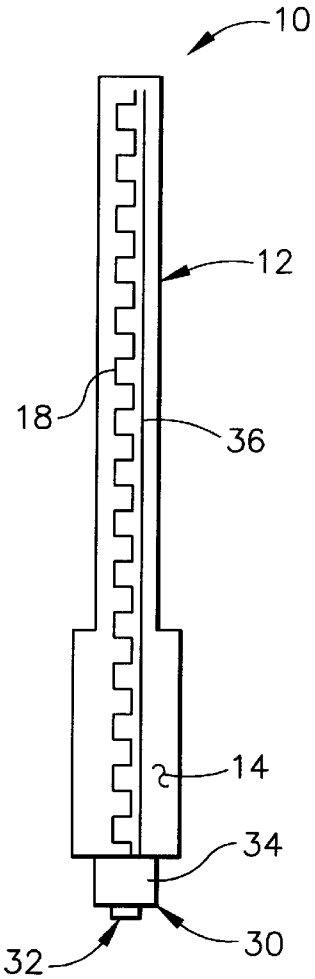
FIG. 5 is a schematic left side view of an alternative embodiment for a multiple band printed monopole antenna including multiple radiating elements formed thereon.

An alternative configuration for printed monopole antenna 10 is depicted in FIG. 5, where a second conductive trace 36 is formed adjacent to first conductive trace 18 on printed circuit board first side 14. First and second conductive traces 18 and 36, respectively, are preferably oriented substantially parallel to each other and have substantially equivalent physical lengths. It will be understood that parasitic element 20 not only may be utilized to affect the frequency band at which secondary resonance occurs for first conductive trace 18, but also for second conductive trace 36. Further, as indicated hereinabove, no direct electrical connection exists between parasitic element 20 and first or second conductive traces 18 and 36. Likewise, no direct electrical connection exists between first and second conductive traces 18 and 36.

It will be understood that first and second conductive traces 18 and 36 may have different physical lengths to better distinguish the frequency bands of resonance therefor, but the main criteria is that they have different electrical lengths. As such, it will be seen that at least one of first and second conductive traces 18 and 36 will have a physical length less than its electrical length. Of course, as seen in FIG. 5, at least one of first and second conductive traces 18 and 36 may have an electrical length substantially equivalent to its physical length.

Having shown and described the preferred embodiment of the present invention, further adaptations of the multiple band printed monopole antenna can be accomplished by appropriate modifications by one of ordinary skill in the art without departing from the scope of the invention.

What is claimed is:

1. A printed monopole antenna having a ground plane defined substantially perpendicular thereto and being operable within a first specified frequency band and a second specified frequency band, comprising:

(a) a first printed circuit board having a first side and a second side, said printed circuit board lying in a plane substantially perpendicular to said ground plane;

(b) a monopole radiating element comprising a conductive trace formed on said printed circuit board first side, said conductive trace having an electrical length so as to have a primary resonance within said first specified frequency band;

(c) a feed port including a signal feed portion and a ground portion, said signal feed portion being coupled only to the feed end of said conductive trace; and (d) a parasitic element formed on said printed circuit board second side, wherein no direct electrical connection exists between said monopole radiating element and said parasitic element, said parasitic element covering a specified area so as to tune said conductive trace to have a secondary resonance within said second specified frequency band.

2. The printed monopole antenna of claim 1, said conductive trace having a physical length from a feed end to an opposite end.

3. The printed monopole antenna of claim 2, wherein said physical length of said conductive trace is substantially equivalent to said electrical length of said conductive trace.

4. The printed monopole antenna of claim 2, wherein said physical length of said conductive trace is less than said electrical length of said conductive trace.

5. The printed monopole antenna of claim 1, wherein said first specified frequency band is approximately 800 MegaHertz to approximately 1000 MegaHertz.

6. The printed monopole antenna of claim 1, wherein said second specified frequency band is approximately 1800 MegaHertz to approximately 2000 MegaHertz.

7. The printed monopole antenna of claim 1, wherein said electrical length of said conductive trace is substantially equivalent to a quarter wavelength for a frequency within said first specified frequency band.

8. The printed monopole antenna of claim 1, wherein said electrical length of said conductive trace is substantially equivalent to a half wavelength for a frequency within said first specified frequency band.

9. The printed monopole antenna of claim 1, wherein said feed port comprises a coaxial connector.

10. The printed monopole antenna of claim 1, wherein said printed circuit board is made of a flexible dielectric material.

11. The printed monopole antenna of claim 1, wherein said printed circuit board, said conductive trace, and said parasitic element are overmolded.

12. The printed monopole antenna of claim 1, wherein said parasitic element is made of a conductive material.

13. The printed monopole antenna of claim 1, wherein said parasitic element has a physical length approximately ten percent or less of said conductive trace electrical length.

14. The printed monopole antenna of claim 2, wherein said parasitic element is positioned on said printed circuit board at an end opposite said conductive trace feed end.

15. The printed monopole antenna of claim 2, wherein said parasitic element has a physical length approximately ten percent or less than said physical length of said conductive trace.

16. The printed monopole antenna of claim 1, wherein said parasitic element fully covers said printed circuit board second side from a first point to a second point.

17. The printed monopole antenna of claim 1, wherein said parasitic element partially covers said printed circuit board second side from a first point to a second point.

18. The printed monopole antenna of claim 1, wherein said second specified frequency band does not include an integer multiple of said primary resonance frequency within said first specified frequency band.

19. The printed monopole antenna of claim 1, wherein said parasitic element is sized to be a non-resonant element.

20. A printed monopole antenna having a ground plane defined substantially perpendicular thereto and being operable within a first specified frequency band and a second specified frequency band, comprising:

(a) a substantially planar printed circuit board having a first side and a second side, said printed circuit board lying in a plane substantially perpendicular to said ground plane;

(b) a monopole radiating element comprising a conductive trace formed on said printed circuit board first side, said conductive trace having an electrical length so as to have a primary resonance within said first specified frequency band;

(c) a feed port including a signal feed portion and a ground portion, said signal feed portion being coupled only to the feed end of said first conductive trace; and (d) a non-resonant parasitic element formed on said printed circuit board second side, wherein no direct electrical connection exists between said monopole radiating element and said parasitic element, said parasitic element being positioned and configured to tune a secondary or higher mode resonant response of said conductive trace to said second specified frequency band which does not include an integer multiple of a frequency within said first specified frequency band.

21. A printed monopole antenna having a ground plane defined substantially perpendicular thereto and being operable within a plurality of specified frequency bands, comprising:

(a) a substantially planar printed circuit board having a first side, a second side, a feed end, and an open end, said printed circuit board lying in a plane substantially perpendicular to said ground plane;

(b) a plurality of monopole radiating elements, each said monopole radiating element comprising a conductive trace formed on said printed circuit board first side, wherein each conductive trace has a specified electrical length so as to have a primary resonance within a first specified frequency band; and (c) a feed port including a signal feed portion and a ground portion, said signal feed portion being coupled only to the feed end of one said conductive trace;

(d) a parasitic element formed on said printed circuit board second side, wherein no direct electrical connection exists between said monopole radiating elements and said parasitic element, said parasitic element covering a specified area so as to tune each of said conductive traces to have a secondary resonance within a second designated frequency band.

22. The printed monopole antenna of claim 21, wherein said conductive traces are oriented substantially parallel to each other.

23. The printed monopole antenna of claim 21, wherein said conductive traces have substantially equivalent physical lengths.

24. The printed monopole antenna of claim 21, wherein at least one of said conductive traces has a physical length different than said remaining conductive traces.

25. The printed monopole antenna of claim 21, wherein no direct electrical connection exists between said plurality of monopole radiating elements.

26. The printed monopole antenna of claim 21, wherein at least one of said conductive traces has a physical length less than its electrical length.

27. The printed monopole antenna of claim 21, wherein at least one of said conductive traces has a physical length substantially equivalent to its electrical length.

28. The printed monopole antenna of claim 21, wherein said parasitic element is positioned on said printed circuit board at said open end.

29. The printed monopole antenna of claim 21, wherein said parasitic element substantially covers said printed circuit board second side from a first point to a second point.

30. The printed monopole antenna of claim 21, wherein said parasitic element partially covers said printed circuit board second side from a first point to a second point.

31. The printed monopole antenna of claim 21, wherein said secondary resonance for each said conductive trace occurs at a frequency which is not an integer multiple of said respective primary resonance frequency.

32. The printed monopole antenna of claim 21, wherein said parasitic element is sized to be a non-resonant element.

* * * * *

UNITED STATES PATENT AND TRADEMARK OFFICE

CERTIFICATE OF CORRECTION

PATENT NO. : 6,100,848
DATED : August 8, 2000
INVENTOR(S) : Gerard James Hayes

It is certified that error appears in the above-identified patent and that said Letters Patent is hereby corrected as shown below:

Column 6,
Line 20, delete [fully] and insert substantially.
Line 41, delete [so as] and insert sized.
Line 42, delete [have] and insert provide.

Column 7,
Line 6, insert and after semicolon.
Line 21, insert unique physical length.
Line 22, delete [different than said remaining conductive traces.]

Signed and Sealed this

Fourteenth Day of August, 2001

*Attest:*

Nicholas P. Godici

*Attesting Officer*

NICHOLAS P. GODICI
*Acting Director of the United States Patent and Trademark Office*